US007150327B2

(12) United States Patent
Surjaatmadja

(10) Patent No.: US 7,150,327 B2
(45) Date of Patent: Dec. 19, 2006

(54) WORKOVER UNIT AND METHOD OF UTILIZING SAME

(75) Inventor: Jim B. Surjaatmadja, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 364 days.

(21) Appl. No.: 10/819,592

(22) Filed: Apr. 7, 2004

(65) Prior Publication Data

US 2005/0224232 A1 Oct. 13, 2005

(51) Int. Cl.
*E21B 33/04* (2006.01)

(52) U.S. Cl. ..... 166/379; 166/77.51; 166/85.4

(58) Field of Classification Search ..... 166/379, 166/380, 77.51, 85.4
See application file for complete search history.

(56) References Cited

U.S. PATENT DOCUMENTS 4,541,490 A * 9/1985 Bigbie et al. ..... 166/379
5,247,776 A 9/1993 Tamayo ..... 52/745.17
5,529,127 A 6/1996 Burleson et al. ..... 166/380
5,765,642 A 6/1998 Surjaatmadja ..... 166/297
6,666,266 B1 12/2003 Starr et al. ..... 166/90.1
6,688,393 B1 2/2004 Sredensek et al. ..... 166/377

OTHER PUBLICATIONS

"Hydraulic Workover Unit," from High Arctic Well Control Inc. (1 page), Mar. 31, 2004.
Catalogue list from Ray Oil Tool Co., The centralization specialists (1 page), Mar. 31, 2004.

* cited by examiner

*Primary Examiner*—William Neuder
(74) *Attorney, Agent, or Firm*—John W. Wustenberg; Baker Botts L.L.P.

(57) ABSTRACT

According to one embodiment of the invention, a method for wellbore production enhancement includes determining a location of a tubing connector of a tubing string having a plurality of tube sections, translating one or more slips downward to hold a position of the tubing string, disconnecting one of the tube sections above the tubing connector, thereby causing the discharge of a liquid out of the tubing string, directing the discharged liquid to a fluid containment, re-attaching the disconnected tube section to the tubing string, translating the tubing string upwardly, and disconnecting the tube section again.

20 Claims, 2 Drawing Sheets

WORKOVER UNIT AND METHOD OF UTILIZING SAME

BACKGROUND

The present invention relates generally to wellbore production enhancement operations and, more particularly, to a workover unit and method of utilizing same.

Various procedures have been utilized to increase the flow of hydrocarbons from subterranean formations penetrated by wellbores. For example, a commonly used production enhancement technique involves creating and extending fractures in the subterranean formation to provide flow channels therein through which hydrocarbons flow from the formation to the wellbore. The fractures are created by introducing a fracturing fluid into the formation at a flow rate which exerts a sufficient pressure on the formation to create and extend fractures therein. Solid fracture proppant materials, such as sand, are commonly suspended in the fracturing fluid so that upon introducing the fracturing fluid into the formation and creating and extending fractures therein, the proppant material is carried into the fractures and deposited therein, whereby the fractures are prevented from closing due to subterranean forces when the introduction of the fracturing fluid has ceased.

Because hydraulic fracturing boasts on time reduction, waiting for the pressure to drop to zero or killing the well is not a feasible option when moving to the next location (i.e., stripping). Therefore, stripping is done "wet" or under pressure in the annulus and the tubing string is often full of fluid, which may cause undesirable situations, such as releasing fluid to the floor when disconnecting. Even though a hydraulic workover ("HWO") unit is designed for many applications and must be able to handle all different kinds of situations, the use of HWO units in hydraulic fracturing is a slow, awkward process.

SUMMARY

According to one embodiment of the invention, a method for wellbore production enhancement includes determining a location of a tubing connector of a tubing string having a plurality of tube sections, translating one or more slips downward to hold a position of the tubing string, disconnecting one of the tube sections above the tubing connector, thereby causing the discharge of a liquid out of the tubing string, directing the discharged liquid to a fluid containment, re-attaching the disconnected tube section to the tubing string, translating the tubing string upwardly, and disconnecting the tube section again.

According to another embodiment of the invention, a method for controlling wellbore fluids includes disposing a resilient member within a channel formed in a housing, coupling a housing to a wellbore such that a tubing string extends through a passageway formed in the housing, coupling the channel to the wellbore, and allowing a pressure existing in the wellbore to enter the channel and exert a force on an outside surface of the resilient member so that the resilient member constricts around the tubing string.

Some embodiments of the invention provide numerous technical advantages. Some embodiments may benefit from some, none, or all of these advantages. For example, according to certain embodiments, stripping is done in a timely fashion, even during hydraulic fracturing operations. Tubing may be quickly and efficiently disconnected while avoiding fluid release from tubing when stripping wet, thereby avoiding environmental issues. As liquids are discharged, they exit safely into a fluid containment with no spillage. In addition, according to certain embodiments, blowout preventer ("BOP") rubbers are not overly excited because the BOP's are hydraulically controlled using an amplification feedback system, which is essentially an intensifier system (water over hydraulic fluid) to control the BOP's at about 5–10% over the pressure below the BOP's. Therefore, the BOP's are very dependable.

DETAILED DESCRIPTION

Figure 1:
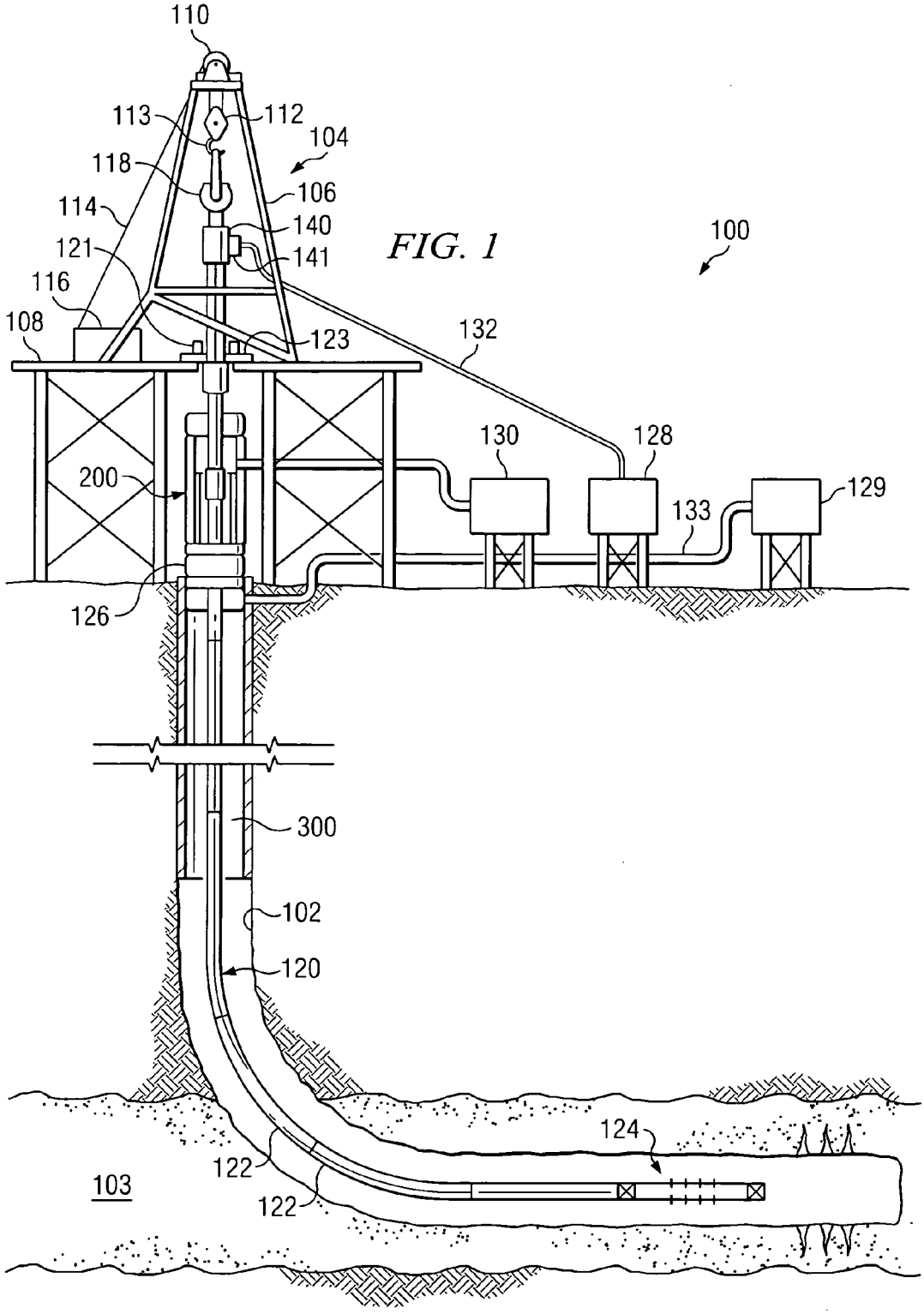
FIG. 1 is an elevation view of a production enhancement system for a wellbore in accordance with one embodiment of the present invention.

FIG. 1 is an elevation view of a production enhancement system 100 for a wellbore 102 in accordance with one embodiment of the present invention. In this embodiment, a rig 104 is a conventional draw works-type rig; however, the present invention contemplates other suitable rigs, including offshore rigs, useful with the present invention.

In the illustrated embodiment, rig 104 includes a mast 106 supported above a rig floor 108. A lifting gear associated with rig 104 includes a crown block 110 mounted to mast 106 and a traveling block 112. Crown block 110 and traveling block 112 are coupled by a cable 114 that is driven by draw works 116 to control the upward and downward movement of traveling block 112.

Traveling block 112 carries a hook 113 from which is suspended a swivel 118. Below swivel 118 is suspended a high pressure swivel 140 into which a mud hose 132 is connected through a master valve 141, which is used for controlling well pressure when needed. High pressure swivel 140 supports a tubing string, designated generally by the numeral 120, in wellbore 102. A rotary table 123 works in conjunction with swivels 118 and 140 to turn the tubing string 120. Tubing string 120 may be held by slips 121 during connections and rig-idle situations or at other appropriate times. Tubing string 120 includes a plurality of interconnected tube sections 122, which may be any suitable tube sections having any suitable diameter and formed from any suitable material.

In the illustrated embodiment, system 100 is being utilized for performing hydraulic fracturing of a subterranean zone 103, such as the SURGIFRAC fracturing process by Halliburton. As such, tubing string 120 includes a hydraulic fracturing sub 124 coupled at an end thereof. However, system 100 may be utilized to perform other suitable production enhancement operations and, therefore, tubing string 120 may include different elements or more or fewer elements than those illustrated.

For hydraulic fracturing and other suitable high pressure production enhancement operations, after the initial operation, the downhole tool is often moved within the wellbore to perform subsequent operations. For efficiency purposes, this stripping is often done "wet" or under pressure in the annulus and the tubing string is often full of fluid.

To aid in stripping wellbore 102, a workover unit 200, which is described in greater detail below in conjunction with FIGS. 2, 3A and 3B, works in conjunction with one or more safety devices 126 and rig 104 to quickly and efficiently disconnect tube sections 122 in a manner that avoids undesired or detrimental fluid release from the tubing string when stripping wet. The present invention is particularly useful during hydraulic fracturing operations or other suitable high-pressure wellbore operations. In the illustrated embodiment, workover unit 200 along with safety devices 126 are disposed between rig floor 108 and the ground surface; however, other suitable locations are contemplated by the present invention.

Also associated with the stimulation operation are stimulation pumps 128 that pump stimulation fluid into the well through mud hose 132 into the tubing string 120, while another set of pumps 129 deliver annulus pressure controlling fluids into annular space 300 through pipe 133. Fluid retrieved from tubing string 120 due to the stripping process is directed into mud tanks 130 or other suitable containment vessel.

Figure 2:
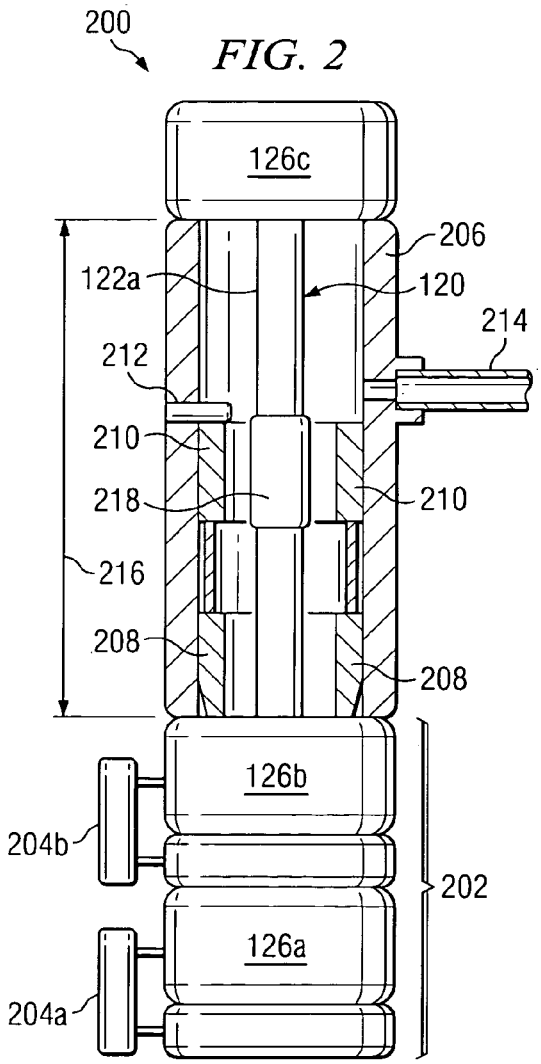
FIG. 2 is an elevation view, in partial cross-section, of a workover unit in accordance with one embodiment of the present invention.

FIG. 2 is an elevation view, in partial cross-section, of workover unit 200 in accordance with one embodiment of the present invention. In the illustrated embodiment, workover unit 200 is disposed between a stack 202 of safety devices 126*a*, 126*b* at a lower end thereof and a safety device 126*c* at an upper end thereof. In one embodiment, safety devices 126*a*, 126*b*, 126*c* are annular blow out preventers (BOPs); however, safety devices 126*a*, 126*b*, 126*c* may be any suitable safety devices, or combination of safety devices, that prevent fluid from wellbore 102 from escaping wellbore 102. For example, safety device 126*c* may be a ram-type BOP, while safety devices 126*a* and 126*b* are annular BOPs, as illustrated in FIG. 2. In another embodiment, safety device 126*c* may be an annular BOP, while below it an additional pipe ram BOP is used. This may be done if annular space 300 is expected to be pressurized at the time tubing string 120 is almost totally removed from wellbore 102 where the weight of tubing string 120 could not hold itself in wellbore 102 (e.g., tubing string 120 is being ejected out of wellbore 102 by well pressure). Associated with safety devices 126*a* and 126*b* in the illustrated embodiment are amplification devices 204*a* and 204*b*, which are described in greater detail below in conjunction with FIG. 4. Generally, amplification devices 204*a*, 204*b* function to amplify the pressure existing in wellbore 102 before it enters their respective safety device and apply backpressure thereto, as described in more detail below.

Workover unit 200, in the illustrated embodiment, includes a main body 206, one or more slips 208 disposed within main body 206, one or more hydraulic cylinders 210 coupled to respective slips 208, a sensor 212, and a return line 214. In one embodiment, workover unit 200 is smaller than existing hydraulic workover units so that it may be used with rig 104 or other suitable rig. For example, a length 216 of main body 206 may be no more than about thirty feet. This allows workover unit 200 to be disposed, in one embodiment, between rig floor 108 and the ground surface (FIG. 1). Other suitable lengths 216 are contemplated by the present invention.

Although main body 206 may be any suitably shaped housing formed from any suitable material, main body 206 is illustrated as a cylindrically-shaped element that allows tubing string 120 to extend therethrough in addition to housing slips 208 and hydraulic cylinders 210. Main body 206, in conjunction with safety devices 126*a* and 126*b* in FIG. 2, function to prevent liquid existing in tubing string 120 from releasing to the environment to protect workers and prevent any potential hazards or contamination. In another embodiment, return line 214 may be connected to a valve (not shown) that can be closed; hence, main body 206 must be able to withstand pressure for proper well containment.

In order to release fluids from tubing string 120, slips 208 function to hold a position of tubing string 120 during disconnecting of tubing sections from tubing string 120. Any suitable slips may be utilized; however, in the illustrated embodiment, slips 208 are controlled by hydraulic cylinders 210 associated with respective slips 208. Hydraulic cylinders 210 function to translate respective slips 208 upward and downward. Any suitable number of slips 208 may be utilized. Hydraulic cylinders 210, which may any suitable hydraulic cylinders that are controlled in any suitable manner, drop slips 208 downward to hold the positioning of tubing string 120 when a tubing connector 218 is at a desired location within main body 206.

The desired location of tubing connector 218 may be determined using any suitable method; however, in the illustrated embodiment, sensor 212 is utilized to sense a location of tubing connector 218. Sensor 212 may be any suitable sensor coupled to main body 206 in any suitable manner. In addition, sensor 212 may communicate the position of tubing connector 218 in any suitable manner. In one embodiment, sensor 212 is a proximity sensor well known in the art; however, in other embodiments, sensor 212 may be a magnetic sensor, a simple limit switch, or other suitable sensors. When tubing connector 218 is at the desired position, a tubing section above tubing connector 218 may be disconnected from tubing string 120 so that fluids existing in tubing string 120 below tubing connector 218 may be discharged into main body 206. Drain line 214 functions to deliver this discharged liquid to mud tanks 130 (FIG. 1) or other suitable location. Drain line 214 may be any suitable conduit operable to transport fluid under any suitable wellbore pressure and may be coupled to the main body 206 in any suitable manner.

An operation of one embodiment of workover unit 200 is now described with the assumption that a hydraulic fracturing operation has just been performed and stripping is now desired. First, tubing string 120 is translated upwardly through wellbore 102 until sensor 212 senses tubing connector 218 at a desired location near drain line 214. The translation of tubing string 120 is then stopped and slips 208 are set. Then a tube section 122*a* existing above tubing connector 218 is then disconnected via rig 104 to cause the discharge of liquid existing in tubing string 120 out the open end and into main body 206. Because of gravity flow, the fluid is forced out through drain line 214 and transported to mud tanks 130 (FIG. 1) or other suitable containment location. Tube section 122*a* is then reattached to tubing connector 218 via rig 104 and then translated upwardly to a position above rig floor 108 (FIG. 1). Tube section 122*a* is then disconnected again and suitably removed from tubing string 120. The process is then repeated for the rest of tube sections 122 of tubing string 120 or until the stripping operation is completed. During the stripping operation, safety devices 126*a*, 126*b*, 126*c* prevent fluid from exiting the annular space between tubing string 120 and wellbore 102. When large rigs are utilized, multiple joints may be pulled at one time; generally up to three joints for each pull. This makes a device such as workover unit 200 quite effective in performing a stripping operation.

Thus, stripping is done in a timely fashion because translation of tubing string 120 is performed without having to wait for pressure to bleed off, which is especially important during high-pressure operations, such as hydraulic fracturing. Tube sections 122 may be quickly and efficiently disconnected while avoiding fluid release from tubing string 120, thereby avoiding any environmental issues or hazardous conditions.

Figure 3A:
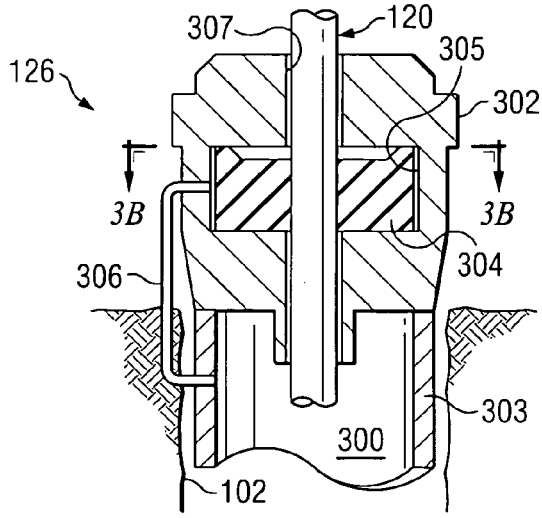
FIGS. 3A and 3B are cross-sectional views of an annular blowout preventer in accordance with an embodiment of the present invention.
Figure 3B:
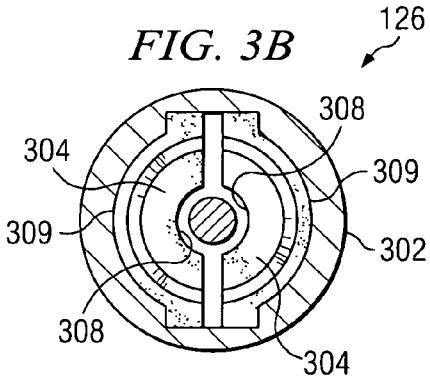

FIGS. 3A and 3B are cross-sectional views of an example safety device 126 in accordance with one embodiment of the present invention. Safety device 126 resembles an annular BOP; however, as described above, safety device 126 may be any suitable device that prevents fluid from escaping an annular space (as denoted by reference numeral 300) from wellbore 102. In the illustrated embodiment, safety device 126 includes a housing 302 coupled to a casing 303 disposed in wellbore 102, a resilient member 304 disposed within a channel 305 formed in housing 302, and a conduit 306 coupling channel 305 to a hydraulic pump, which controls its pressure much higher than the annular pressure of annular space 300. Also illustrated in FIG. 3A is tubing string 120 extending through a passageway 307 formed in housing 302.

Housing 302 may be any suitable configuration and formed from any suitable material. Housing 302 may couple to casing 303 and/or wellbore 102 in any suitable manner. Resilient member 304 may also have any suitable configuration and may be formed from any suitable material, such as rubber. In the illustrated embodiment, resilient member 304 is a pair of opposed semiannular resilient elements, in which inside surfaces 308 of resilient member 304 generally conforms to the outside surface of tubing string 120.

Conduit 306, in one embodiment, is generally connected to a hydraulic pump that controls the pressure of channel 305 to a safe level much higher than the pressure of annular space 300. The fluid may be any suitable fluid, such as air plus fluid used for hydraulic fracturing or other suitable production enhancement operation. Conduit 306 may be coupled to wellbore 102 and/or casing 303 in any suitable manner and may couple to housing 302 in any suitable manner.

In operation, a fluid existing in annular space 300 due to, for example, a hydraulic fracturing operation travels upward towards the safety device 126. Hydraulic pressure delivered by the hydraulic pump maintains a high pressure through conduit 306 into channel 305 and exerts a force on outside surface 309 of resilient member 304 in order to constrict resilient member 304 around an outside surface of tubing string 120. This substantially reduces or eliminates any of the fluid in annular space 300 from seeping through passageway 307 of housing 302 due to the pressure existing in annular space 300. Because a horizontal force is being applied to resilient member 304, there is less chance of resilient members 304 failing and allowing the high-pressure fluid existing in annular space 300 from escaping to the environment and causing harm. This approach is very well accepted today and is very practical in static situations where pipe movements are not being performed. The high pressure in channel 305 causes an extremely high force to the resilient members 304 against tubing string 120 so that no fluid may escape the device through passageway 307. However, when movement of tubing string 120 is necessary, this high friction force may tear resilient members 304 and create detrimental results. Carefully reducing the control pressure down may be done to reduce damage to resilient members 304; however, this is time-consuming and may cause unnecessary fluid release, which may not be contained.

Figure 4:
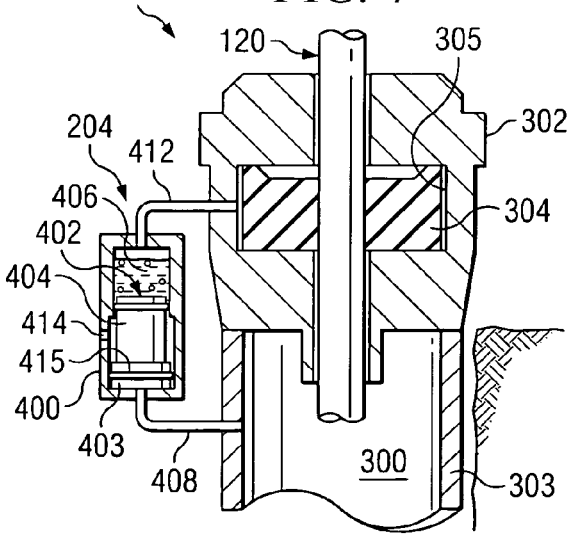
FIG. 4 is a cross-sectional view of an. annular blowout preventer in accordance with another embodiment of the present invention.

FIG. 4 is a cross-sectional view of a safety device 126 according to another embodiment of the present invention. The embodiment illustrated in FIG. 4 is similar to the embodiment illustrated in FIGS. 3A and 3B; however, in the embodiment illustrated in FIG. 4, amplification system 204 is utilized to amplify the pressure of the fluid existing in annular space 300 before entering channel 305 in housing 302.

This amplification system 204 may be any suitable amplifier and may amplify the pressure to any suitable level. In a particular embodiment, the pressure is amplified in a range of about five to about ten percent. This may be accomplished, in the illustrated embodiment, by amplification system 204 that includes a housing 400 with a piston 402 disposed therein. Piston 402 includes two sections 403 and 404 having unequal diameters in order to amplify the pressure of a hydraulic fluid 406 existing in the upper portion of housing 400.

A conduit 408 is coupled to wellbore 102 or annular space 300 at one end and housing 400 at the other end in order to deliver the high-pressure fluid inside housing 400. An additional conduit 412 couples an upper portion of housing 400 to channel 305 of housing 302 in order to deliver high-pressure hydraulic fluid or other suitable fluid 406 to channel 305. Amplification system 204 may also have a bleed off valve 414 associated therewith that transports any fluid that leaks past a seal 415 associated with larger diameter section 403 or a seal associated with smaller diameter section 404.

In operation, pressurized fluid enters conduit 408 and, because its under high pressure, pushes piston upwardly through housing 400, which pressurizes hydraulic fluid 406. Hydraulic fluid 406 then travels through conduit 412 and into channel 305. Hydraulic fluid 406 exerts a force on the outside surfaces of resilient member 304 in order to constrict resilient member 304 around tubing string 120 so that it may function as described above in conjunction with FIGS. 3A and 3B.

The smaller diameter section 404 of piston 402 facilitates the amplification of the pressure. This additional pressure prevents resilient member 304 from being overly excited, which makes it very reliable. The difference between the diameters of sections 403, 404 of piston 402 may be any suitable difference depending on how much amplification is desired. However, in one embodiment, the difference in diameters is no more than approximately one-sixteenth of an inch. As the pressure in channel 305 is just a little above the fluid pressure to be controlled, "just right" sealing may be performed, meaning that the contact force is not excessive and the tubing sections of tubing string 120 may be stripped without tearing resilient members 304.

Although some embodiments of the present invention are described in detail, various changes and modifications may be suggested to one skilled in the art. The present invention intends to encompass such changes and modifications as falling within the scope of the appended claims.

What is claimed is:

1. A wellbore production enhancement system, comprising:

a tubing string disposed within a wellbore;

a rig operable to translate the tubing string within a wellbore and further operable to disconnect one or more tubing sections associated with the tubing string;

a workover unit disposed between a ground surface and a rotary table associated with the rig, the workover unit comprising:

a main body;

a sensor coupled to the main body;

one or more slips disposed within the main body and configured to hold a position of the tubing string; and a return line coupled to the main body and operable to direct liquid into a fluid containment; and one or more safety devices disposed below the main body.

2. The system of claim 1, wherein the sensor is operable to detect a location of a tubing connector within the main body.

3. The system of claim 1, further comprising a hydraulic fracturing sub coupled to the tubing string.

4. The system of claim 1, wherein the main body is no more than thirty feet in length.

5. The system of claim 1, wherein the workover unit further comprises a hydraulic system disposed within the main body and operable to translate the slips within the main body.

6. The system of claim 1, wherein the safety devices are annular blowout preventers.

7. The system of claim 6, further comprising an amplifying feedback system operable to hydraulically control the annular blowout preventers in a range of five to ten percent over the pressure in an annular space within the wellbore.

8. A method for wellbore production enhancement, comprising:

determining a location of a tubing connector of a tubing string having a plurality of tube sections;

translating one or more slips downward to hold a position of the tubing string;

disconnecting one of the tube sections above the tubing connector, thereby causing the discharge of a liquid out of the tubing string;

directing the discharged liquid to a fluid containment;

re-attaching the disconnected tube section to the tubing string;

translating the tubing string upwardly; and disconnecting the tube section again.

9. The method of claim 8, further comprising repeating each of the steps for subsequent tube sections.

10. The method of claim 8, wherein determining the location of the tubing connector further comprises:

translating the tubing string upwardly through a wellbore; and sensing a location of the tubing connector.

11. The method of claim 10, further comprising, before translating the tubing string, performing hydraulic fracturing of a subterranean zone with the tubing string.

12. The method of claim 8, wherein translating one or more slips downward comprises hydraulically translating a plurality of slips downward.

13. The method of claim 8, wherein each of the translating steps are performed by a rig.

14. The method of claim 13, wherein translating the tubing string upwardly comprises translating the tubing string upwardly to a position above a floor of the rig.

15. A workover unit for use in connection with a rig operable to translate a tubing string within a wellbore, comprising:

a main body operable to have the tubing string translated therethrough;

a sensor coupled to the main body;

one or more slips disposed within the main body and operable to secure a position of the tubing string to allow disconnection of one or more tubing sections associated with the drill string within the main body; and the main body operable to collect fluids released from the tubing string as a result of the disconnection.

16. The system of claim 15, further comprising a return line coupled to the main body and operable to direct released fluids into a fluid containment.

17. The system of claim 15, wherein the sensor is operable to detect a location of a tubing connector within the main body.

18. The system of claim 15, wherein the slips are further operable to allow re-connection of the disconnected tubing section.

19. The system of claim 15, wherein the main body is no more than thirty feet in length.

20. The system of claim 15, further comprising a hydraulic fracturing sub coupled to the tubing string.

* * * * *